US006360538B1

(12) United States Patent
McGowan et al.

(10) Patent No.: US 6,360,538 B1
(45) **Date of Patent: *Mar. 26, 2002**

(54) METHOD AND AN APPARATUS FOR AN ELECTRO-HYDRAULIC SYSTEM ON A WORK MACHINE

(75) Inventors: Mitchell J. McGowan, Groveland; Clifford E. Miller, Marseilles, both of IL (US); Dean J. Schlickbernd, Maple Grove, MN (US); John A. Yeoman, Dunlap, IL (US)

(73) Assignee: Caterpillar Inc., Peoria, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/361,010

(22) Filed: Jul. 27, 1999

(51) Int. Cl.[7] ..... F16D 31/02
(52) U.S. Cl. ..... 60/468; 60/469
(58) Field of Search ..... 60/468, 469

(56) References Cited

U.S. PATENT DOCUMENTS

| | | | | |
|---|---|---|---|---|
| 4,938,022 A | | 7/1990 | Hirata et al. | |
| 4,945,723 A | | 8/1990 | Izumi et al. | |
| 5,062,266 A | * | 11/1991 | Yoshimatsu | 60/494 |
| 5,499,503 A | | 3/1996 | Stoychoff | |
| 5,636,516 A | * | 6/1997 | Kon | 60/468 |

* cited by examiner

*Primary Examiner*—F. Daniel Lopez

(57) ABSTRACT

A method for controllably moving a machinery platform 20 of a work machine 10 having an electro-hydraulic system 100 is disclosed. The work machine 10 includes at least one swing motor 120 configured to move the machinery platform 20. The changing speed of the swing motor 120 is determined. A solenoid actuated valve 165 is controlled in response to the determination. The solenoid actuated valve 165 is configured to responsively produce a relief valve pilot signal 170. The two-way relief valve 130 is controllably shifted in response to the inputted relief valve pilot signal 170. At least one of a high pressure by-pass valve 135 and a low pressure by-pass valve 140 is selected in response to the two-way relief valve 130 shifting.

12 Claims, 3 Drawing Sheets

METHOD AND AN APPARATUS FOR AN ELECTRO-HYDRAULIC SYSTEM ON A WORK MACHINE

TECHNICAL FIELD

This invention relates generally to an electro-hydraulic system for a work machine, and more particularly, to an electro-hydraulic system for a work machine wherein the work machine has a machinery platform moving relative to a lower frame.

BACKGROUND ART

Work machines, of the type having a machinery platform swung relative to the lower frame of the work machine, usually include at least one hydraulic swing motor in conjunction with a ring gear system to produce the swing or movement. Additionally, such work machines range in size, weight and load capacity, and require a substantial structure to withstand the force for swinging and moving. Additionally, a work implement is typically connected to the machinery platform. A common type of work implement has a boom with an attached stick and bucket. Some other types of work implements utilize grappling devices, or tree harvesting devices.

A typical work machine cycle includes sequentially positioning the work implement over the material to be moved, obtaining the material, swinging the implement by means of the machinery platform to a release location. The material is released and then the cycle will be repeated.

It is desirable for operators of work machines to move as much material as quickly as possible. In order to achieve this, operators will accelerate the speed at which the implement, via the machinery platform, is swung between the material obtaining and the material releasing locations. Ideally, the operator would manually reduce the speed of acceleration as the implement approaches the releasing location in order to slow down the implement enough to release the load in the proper location. However, it is quite common for an operator to keep the implement in a maximum acceleration mode until just prior to reaching the releasing location. At this point the operator would immediately put the implement into the mode for reversing the direction of the implement movement, which in effect produces a braking action on the implement movement.

The operator action of immediately going into a reverse mode to halt the movement of the implement and the machinery platform, may cause damage to the work machine. Because the implement has mass and is moving, it contains a sizable quantity of kinetic energy due to inertia of the moving elements. Also, the torque in the implement and the machinery platform during an abrupt deceleration is extremely high due to the kinetic energy. The torque may damage parts of the machinery. The torque may also produce fatigue in the ring gear system and damage the gear teeth and other components associated with swinging the machinery platform. As a consequence, all of the elements involved in swinging the machinery platform and the implement itself must be sized for the high deceleration torque which increases both component size and cost.

The present invention is directed to overcoming one or more of the problems as set forth above.

DISCLOSURE OF THE INVENTION

In one aspect of the present invention, a method for controllably moving a machinery platform of a work machine having an electro-hydraulic system is disclosed. The work machine includes at least one swing motor configured to move the machinery platform. The changing speed of the swing motor is determined. A solenoid actuated valve is controlled in response to the determination. The solenoid actuated valve is configured to responsively produce a relief valve pilot signal. The two-way relief valve is controllably shifted in response to the inputted relief valve pilot signal. At least one of a high pressure by-pass valve and a low pressure by-pass valve is selected in response to the two-way relief valve shifting.

In a second aspect of the present invention, a method for controllably moving a machinery platform of a work machine having an electro-hydraulic system is disclosed. The work machine includes at least one swing motor configured to move the machinery platform. The changing speed of the swing motor is determined. If the determination shows the swing motor is accelerating a solenoid actuated valve is energized. If the determination shows the swing motor is decelerating the solenoid actuated valve is de-energized. A relief valve pilot signal representing the current state of the solenoid actuated valve is produced. The relief valve pilot signal is communicated with a two-way relief valve having a low pressure by-pass valve position and a high pressure by-pass valve position. If, the solenoid actuated valve is energized, the two-way relief valve is shifted to the high pressure by-pass valve position. If, the solenoid actuated valve is de-energized, the two-way relief valve is shifted to the low pressure by-pass valve position. At least one of a high pressure by-pass valve and a low pressure by-pass valve corresponding to the position of the two-way relief valve is engaged.

In a third aspect of the present invention, a work machine having an electro hydraulic system is shown. The machinery platform and the lower frame are included in the work machine, wherein the machinery platform is rotatably connected to the lower frame. A swing motor is located on the work machine. Included in the electro-hydraulic system is a controller. A detector is configured to determine the speed of the swing motor. The controller is in communication with the detector and a solenoid actuated valve. The solenoid actuated valve is included in the electro-hydraulic system. A relief valve pilot signal is produced by the solenoid actuated valve. A two-way relief valve is configured to receive the relief valve pilot signal and to move to a position in response to the relief valve pilot signal.

These and other aspects and advantages of the present invention, as defined by the appended claims, will be apparent to those skilled in the art from reading the following specification in conjunction with the drawings and the claims.

BEST MODE FOR CARRYING OUT THE INVENTION

The present invention provides a method and an apparatus for an electro-hydraulic system on a working machine including a machinery platform with an attached implement and a lower frame. The electro-hydraulic system moves or swings the machinery platform relative to the lower frame of the work machine. The following description uses an excavator with a bucket attached to the implement as an example only. This invention can be applied to other types of work machines having a machinery platform with an attached implement, being pivotally connected to a lower frame, one example being a tree harvesting machine such as a log loader.

Figure 1:
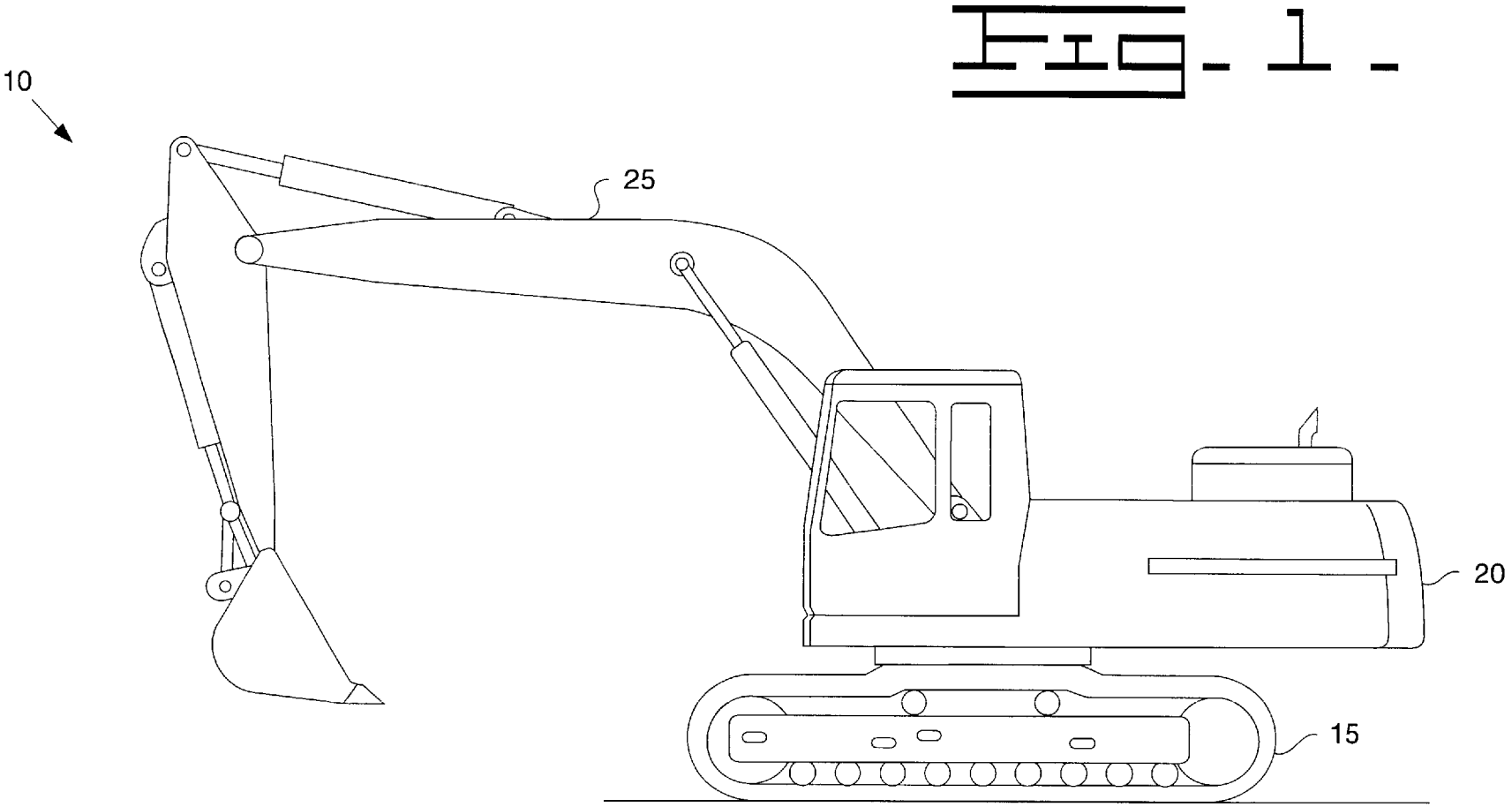
FIG. 1 is a diagrammatic view illustrating an embodiment of the work machine.

With reference to FIG. 1, a diagrammatic view of a work machine 10, in this case an excavator, is shown. The work machine 10 includes a lower frame 15 and a machinery platform 20. The machinery platform 20 is configured to move or swing relative to the lower frame 15. An implement 25 which in this example includes a boom, a stick, and a bucket, is workably attached to the machinery platform 20.

Figure 2:
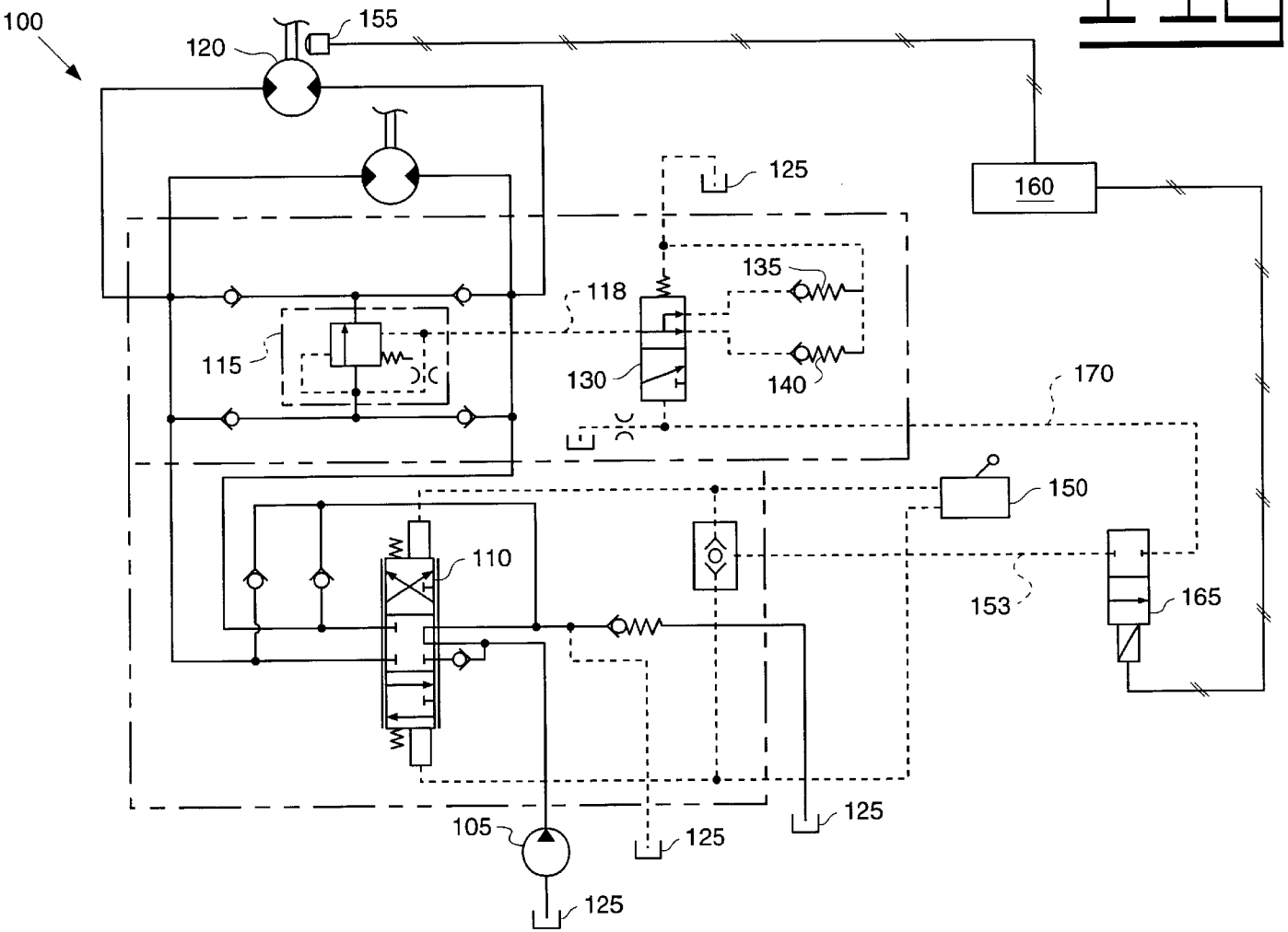
FIG. 2 is a system diagram illustrating an embodiment of invention.

With reference to FIG. 2, an electro-hydraulic system 100 for controllably moving a machinery platform 20 relative to the lower frame 15 of a work machine 10 is shown. The electro-hydraulic system 100 including a hydraulic pump 105 being in fluid communication with a fluid reservoir or tank 125. A fluid supply line connects a main control valve 110 with the hydraulic pump 105. A second fluid supply line connects the main control valve 110 to at least a single swing motor 120. A plurality of swing motors 120 could be used without changing the scope of the present invention. In the preferred embodiment, the swing motor 120, is a bi-directional ring gear motor. A pressure control valve 115 is connected in parallel between the main control valve 110 and the swing motor 120.

Connected by a fluid flow line 118 to the pressure control valve 115 is a two-way relief valve 130. In a first position, the two-way relief valve 130 is connected through a fluid flow line to only a high pressure by-pass valve 135. In a second position the two-way relief valve is connected through a fluid flow line to both a low pressure by-pass valve 140 and the high pressure by-pass valve 135. Naturally, the low pressure by-pass valve 140 will open to control the pressure in the flow line 118. In the preferred embodiment, both the high pressure by-pass valve 135 and the low pressure by-pass valve 140 are one-way valves. Each have a spring and a ball configuration that requires a predetermined pressurized flow to overcome the spring force and allow flow around the ball to the reservoir 125. However, other by-pass valves could be used without deviating from the scope of the present invention.

An operator controlled input device 150, such as a pilot valve having a lever or a foot pedal, is in communication with the main control valve 110 by means of control signals 151*a*, 151*b*. The control signals 151*a*, 151*b* are also connected with a shuttle valve 154 which outputs the input pilot signal 153. As will be readily apparent to those skilled in the art from reference to FIG. 2, the input pilot signal 153 is generated when the operator moves the input device 150 to direct pressurized fluid through either of the signal lines 151*a*, 151*b* to indicate a desired machinery platform 20 or implement 25 movement, such as a change in direction, an acceleration, or a deceleration. The main control valve 110 controls hydraulic fluid flow to the swing motor 120 to operate in a clockwise direction, counter clockwise direction, or in a neutral position by shifting in response to the control signals 151*a*, 151*b* in a well known manner.

Included in the electro-hydraulic system 100 is a detector 155 being in communication with a controller 160, in a conventional manner, located on the work machine 10. The controller 160, preferably is of the type which includes an electronic control module, which includes a microprocessor connected to a memory device and an input/output port. However, other controllers could be readily and easily used without deviating from the scope of the present invention. Although, the embodiment is shown with respect to the detector 155 being a speed sensor, one skilled in the art could readily implement the present invention using other types of detectors. One example of another type of detector 155 is a pressure sensor configured to determine the engine speed by detecting the fluid pressure driving the swing motor 120.

The controller 160 is in communication with a solenoid actuated valve 165 that is connected to the input pilot signal 153. A relief valve pilot signal 170 is generated in response to the communication by shifting the solenoid actuated valve 165 to its open position. In the absence of the control signal, the solenoid actuated valve 165 moves in a conventional manner to the closed position. The relief valve pilot signal 170 is reduced by venting the fluid in the line to the tank across a conventional continuous bleed orifice as illustrated in FIG. 2. The two-way relief valve 130 receives the relief valve pilot signal 170 and is configured to change position in response to receipt of the relief valve pilot signal 170. It is recognized that the relief valve pilot signal 170 can be reduced in various known ways.

Figure 3:
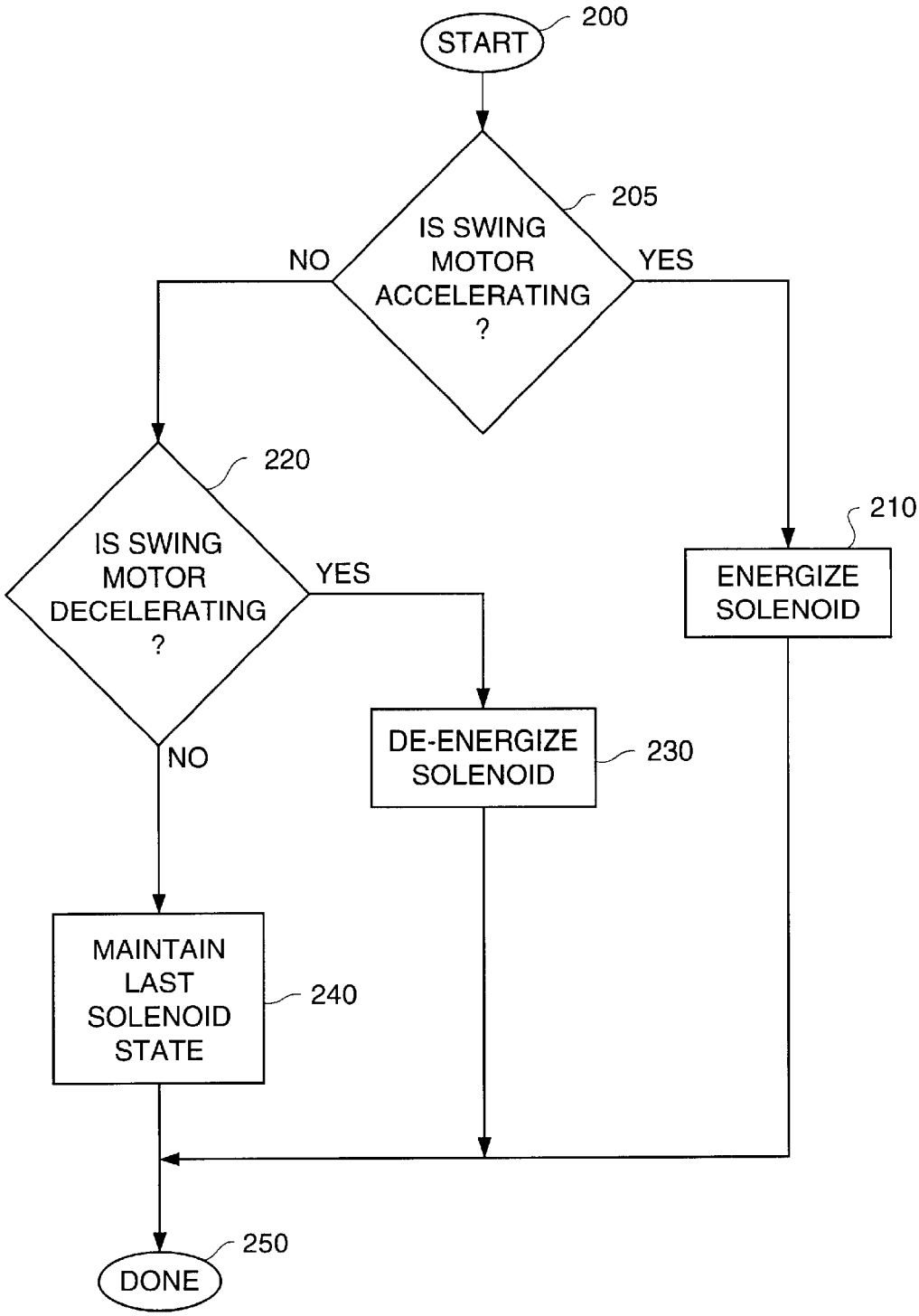
FIG. 3 is a is a flow diagram illustrating an embodiment of the electro-hydraulic system control.

With reference to FIG. 3 a flow diagram illustrating an embodiment of the electro-hydraulic system control, is shown. Block 200 begins the control of the preferred embodiment and program control passes to block 205. In the first decision block 205, using input from the detector 155, the controller 160 determines if the swing motor 120 is accelerating. If the swing motor 120 is accelerating, the software control passes to control block 210. In block 210 the solenoid actuated valve 165 is energized, thereby permitting the input signal 153 to pass thereacross thus generating the relief valve pilot signal 170 and communicating the relief valve pilot signal 170 with the two-way relief valve 130. The two-way relief valve 115 shifts position to connect the high pressure by-pass valve 135 to the line flow 118. In one embodiment the high pressure by-pass valve 135 is set to a predetermined pressure of about 35,000 kPA. However, the predetermined pressure setting for the high pressure by-pass valve 135 is dependent on the requirements of each work machine 10. The software control passes from block 210 to block 250 where the control is done.

If, in the first decision block 200 the controller 160 determines the swing motor 120 is not accelerating, the software control passes to decision block 220. In decision block 220, the controller 160 uses input from the detector 155 to determine if the swing motor 120 is decelerating. If, the swing motor 120 is determined to be decelerating the software control will pass to control block 230.

In control block 230 the solenoid actuated valve 165 is de-energized, causing the relief valve pilot signal 170 to be lowered since the pressure therein is vented to the tank 125 across the continuous bleed orifice. The two-way relief valve 130 shifts position, in response to the lowered relief valve pilot signal 170, to the low pressure by-pass valve 140. In one embodiment the low pressure by-pass valve 140 is set to a predetermined pressure of about 25,000 kPA. However, the predetermined pressure setting for the low pressure by-pass valve 140 is dependent on the requirements of each work machine 10. The software control passes from block 230 to block 250 where the control is done.

If, in decision block 220 the controller 160 determines the swing motor 120 is not decelerating the software control will pass to control block 240. In control block 240 the last state of the solenoid actuated valve 165 is maintained. The software control passes from block 240 to block 250 where the control is done.

INDUSTRIAL APPLICABILITY

In operation, the preferred embodiment described herein is for controllably moving a machinery platform 20 relative to a lower frame 15 of a work machine 10 having an electro-hydraulic system 100. The swing motor 120 moves or swings the machinery platform 20 in a direction and a speed dependent on the position of the operator input device 150 in conjunction with the electro-hydraulic system 100.

Utilizing the operator input device 150, the work machine operator indicates the desired machinery platform 20 movement. For a typical application, an implement 25 attached to the machinery platform 20, is positioned over the material to be moved, and then obtains the material. Next, the operator moves the operator input device 150 to indicated a desired direction and speed of acceleration for the machinery platform 20 to be moved.

As the machinery platform 20 moves in response to the position of the operator input device 150, the detector 155 detects the speed of the swing motor 120. This information is communicated to the controller 160. Using this information, the controller 160 determines whether the swing motor 120 is accelerating and if so, the controller energizes the solenoid actuated valve 165. The solenoid actuated valve 165 responsively directs the input pilot signal 153 thereacross to generate the relief valve pilot signal 170, which is then communicated with the two-way relief valve 130. The two-way relief valve 130 moves to the first position connecting the high pressure by-pass valve 135 to the flow line 118. The high pressure by-pass valve 135 is set at the predetermined value based on the pressure required to start the swing motor 120 moving from a stop.

As the material release location is approached, the operator moves the operator input device 150 to indicate that an immediate braking action on the implement movement is desired. The detector 155 detects the speed of the swing motor 120 and communicates the information with the controller 160. Using this information, the controller 160 determines that the swing motor 120 is decelerating and de-energizes the solenoid actuated valve 165. As described above, the relief valve pilot signal 170 is lowered by the fluid being vented to the tank 125 across the continuous bleed orifice. The two-way relief valve 130 moves to the second position, in response to the lowered relief valve pilot signal 170, connecting the low pressure by-pass valve 140 with the flow line 118. The low pressure by-pass valve 140 is set at the predetermined value based on the pressure required to allow the swing motor 120 to controllably slow down. This action will controllably slow the movement of the implement 25 as it approaches the material release location.

What is claimed is:

1. A method for controllably moving a machinery platform of a work machine having an electro-hydraulic system, and the machinery platform being movable by a swing motor located on the work machine, including the steps of:

determining if the speed of the swing motor is changing;

controlling a solenoid actuated valve in response to determining if the swing motor speed is changing, wherein the solenoid actuated valve is configured to responsively produce a relief valve pilot signal;

inputting the relief valve pilot signal to a two-way relief valve and controllably shifting the two-way relief valve in response to the relief valve pilot signal; and engaging one of a high pressure by-pass valve and a low pressure by-pass valve, wherein one of the high pressure by-pass valve and the low pressure by-pass valve is selected by the shifting of the two-way relief valve.

2. A method as set forth in claim 1, wherein the step of engaging one of the high pressure by-pass valve and the low pressure by-pass valve includes the high pressure by-pass valve and the low pressure by-pass valve being configured with a different predetermined pressure.

3. A method as set forth in claim 1, wherein the step of determining if the swing motor speed is changing speed includes the step of determining if the swing motor is accelerating.

4. A method as set forth in claim 3, wherein the step of engaging one of a plurality of pressure by-pass valves selected by the two-way relief valve shifting includes the step of energizing the solenoid in response to determining if the swing motor is accelerating.

5. A method as set forth in claim 3, including the step of engaging a low pressure by-pass valve wherein the low pressure by-pass valve has a predetermined low pressure.

6. A method as set forth in claim 1, wherein the step of determining if the swing motor speed is changing speed includes the step of determining if the swing motor is decelerating.

7. A method as set forth in claim 6, wherein the step of engaging one of a plurality of pressure by-pass valves selected by the two-way relief valve shifting includes the step of de-energizing the solenoid in response to determining if the swing motor is decelerating.

8. A method as set forth in claim 6, including the step of engaging a high pressure by-pass valve wherein the high pressure by-pass valve has a predetermined high pressure.

9. A method for controllably moving a machinery platform of a work machine having an electro-hydraulic system, and the machinery platform being movable by a swing motor located on the work machine, including the steps of:

determining if the swing motor is accelerating;

energizing a solenoid actuated valve in response to determining if the swing motor is accelerating;

determining if the swing motor is decelerating;

de-energizing the solenoid actuated valve in response to determining if the swing motor is de-accelerating;

producing a relief valve pilot signal representing the current state of the solenoid actuated valve;

communicating the relief valve pilot signal with a two-way relief valve having a low pressure by-pass valve position and a high pressure by-pass valve position;

shifting the position of the two-way relief valve to the high pressure by-pass valve position when the relief valve pilot signal represents the energized solenoid actuated valve;

shifting the position of the two-way relief valve to the low pressure by-pass valve position when the relief valve pilot signal represents the de-energized solenoid actuated valve; and engaging at least one a high pressure by-pass valve and a low pressure by-pass valve corresponding to the position of the two-way relief valve, wherein each one of the plurality of pressure by-pass valves has a different predetermined pressure.

10. A work machine having an electro-hydraulic system, and the work machine having a lower frame and a machinery platform, wherein the machinery platform is rotatably connected to the lower frame, comprising:

a swing motor located on the work machine;

a controller included in the electro-hydraulic system;

a detector included in the electro-hydraulic system, wherein the detector is configured to determine the speed of the swing motor, and to communicate the speed of the swing motor with the controller;

a solenoid actuated valve included in the electro-hydraulic system, wherein the solenoid actuated valve is configured to respond to a communication from the controller;

a pressure control valve operatively connected to the swing motor;

a relief valve pilot signal produced by the solenoid actuated valve;

a two-way relief valve connected to the pressure control valve and configured to receive the relief valve pilot signal;

a high pressure by-pass valve connected to the pressure control valve through the two-way relief valve in response to the relief valve pilot signal being directed to the two-way relief valve; and a low pressure by-pass valve connected to the pressure control valve through the two-way relief valve in response to the absence of the relief valve pilot signal being directed to the two-way relief valve.

11. A work machine having an electro-hydraulic system as set forth in claim 10, further comprising a high pressure by-pass valve included in the electro-hydraulic system wherein the high pressure by-pass valve is responsive to the position of the two-way relief valve.

12. A work machine having an electro-hydraulic system as set forth in claim 10 further comprising a low pressure by-pass valve included in the electro-hydraulic system wherein the low pressure by-pass valve is responsive to the position of the two-way relief valve.

* * * * *